US012214248B2

(12) United States Patent
Jun

(10) Patent No.: US 12,214,248 B2
(45) Date of Patent: Feb. 4, 2025

(54) LEFT AND RIGHT OSCILLATION WIDTH ADJUSTMENT AND ROTATION STRUCTURE OF STATIONARY BIKE SADDLE

(71) Applicant: Woo Sik Jun, Daegu (KR)

(72) Inventor: Woo Sik Jun, Daegu (KR)

( * ) Notice: Subject to any disclaimer, the term of this patent is extended or adjusted under 35 U.S.C. 154(b) by 119 days.

(21) Appl. No.: 17/917,836

(22) PCT Filed: Apr. 7, 2021

(86) PCT No.: PCT/KR2021/004367

§ 371 (c)(1),
(2) Date: Nov. 11, 2022

(87) PCT Pub. No.: WO2021/206453

PCT Pub. Date: Oct. 14, 2021

(65) Prior Publication Data

US 2023/0158362 A1 May 25, 2023

(30) Foreign Application Priority Data

Apr. 10, 2020 (KR) ..... 10-2020-0043804

(51) Int. Cl.
*A63B 22/00* (2006.01)
*A63B 22/06* (2006.01)

(52) U.S. Cl.
CPC .. *A63B 22/0087* (2013.01); *A63B 2022/0641* (2013.01); *A63B 2225/093* (2013.01)

(58) Field of Classification Search
CPC ..... A63B 22/0046; A63B 22/0087; A63B 22/0605; A63B 22/16; A63B 71/0054;
(Continued)

(56) References Cited

U.S. PATENT DOCUMENTS 7,347,806 B2 * 3/2008 Nakano ..... A63B 24/00 434/247
7,427,256 B2 * 9/2008 Fan ..... A63B 69/04 482/64

(Continued)

FOREIGN PATENT DOCUMENTS

JP 2008-073354 A 4/2008
KR 10-2000-0073755 A 12/2000

(Continued)

*Primary Examiner* — Joshua Lee
(74) *Attorney, Agent, or Firm* — Maschoff Brennan

(57) ABSTRACT

Disclosed is a right and left oscillation width adjustment and rotation structure of a stationary bike saddle, which enables a user to directly perform adjustment to correspond to the range of motion of the hip joint while inducing the buffering action of the left and right oscillations of the saddle and the dispersed load when the user sits on the saddle of the stationary bike and pedals thereon, the structure includes: a buffering part which is disposed on the bottom surface of a saddle member to relieve the load and left and right oscillations dispersed by the user's pedaling operation; a left and right moving part which is coupled to the buffering part to perform a left and right sliding motion; a forward and backward moving part which is coupled to the left and right moving part to perform a forward and backward sliding motion; and an eccentric rotating part.

1 Claim, 6 Drawing Sheets

(58) Field of Classification Search
CPC .... A63B 2022/0635; A63B 2022/0641; A63B 2071/0063; A63B 2225/09; A63B 2225/093
See application file for complete search history.

(56) References Cited

U.S. PATENT DOCUMENTS

| | | | | |
|---|---|---|---|---|
| 7,828,705 | B2 * | 11/2010 | Nakano | A63B 69/04 482/142 |
| 8,162,810 | B2 * | 4/2012 | Ozawa | A63B 22/16 482/142 |
| 9,061,174 | B2 * | 6/2015 | Jun | A63B 22/0046 |
| 10,569,129 | B2 * | 2/2020 | Felker | A63B 22/0605 |
| 11,013,955 | B2 * | 5/2021 | Felker | B62M 3/14 |
| 2007/0238586 | A1 * | 10/2007 | Fan | A63B 69/04 482/64 |
| 2008/0300119 | A1 * | 12/2008 | Nakano | A63B 26/003 482/142 |
| 2013/0123074 | A1 * | 5/2013 | Jun | A63B 22/0087 297/195.11 |
| 2017/0368409 | A1 * | 12/2017 | Felker | B62K 21/125 |
| 2020/0206566 | A1 * | 7/2020 | Felker | B62M 1/12 |

FOREIGN PATENT DOCUMENTS

| | | | |
|---|---|---|---|
| KR | 20-0418024 | Y1 | 6/2006 |
| KR | 20100016866 | A | 2/2010 |
| KR | 101040456 | B1 | 6/2011 |
| KR | 10-1066280 | B1 | 9/2011 |
| KR | 10-1160587 | B1 | 7/2012 |
| KR | 10-2149785 | B1 | 8/2020 |

* cited by examiner

[FIG. 1]
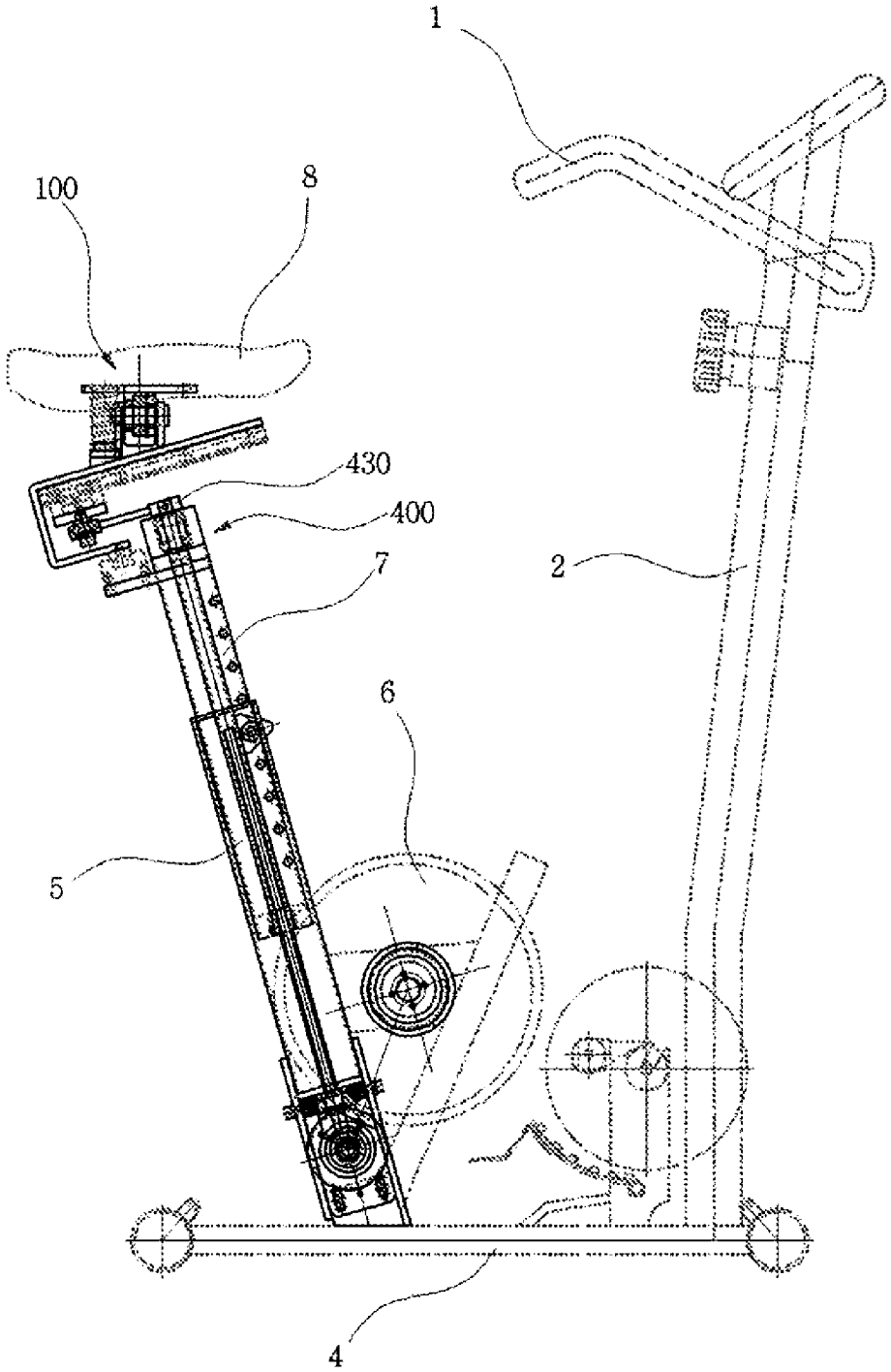

[FIG. 2]
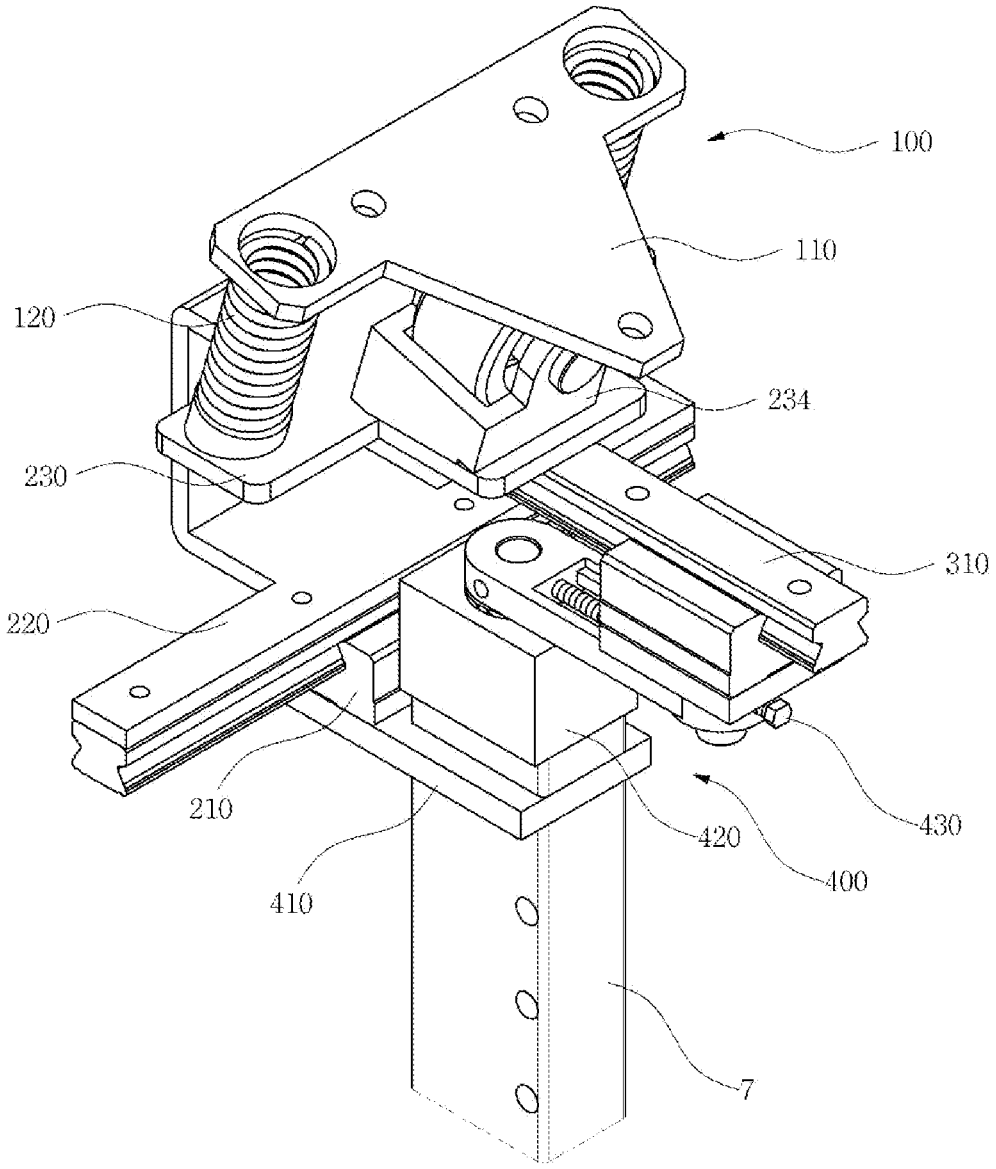

[FIG. 3]
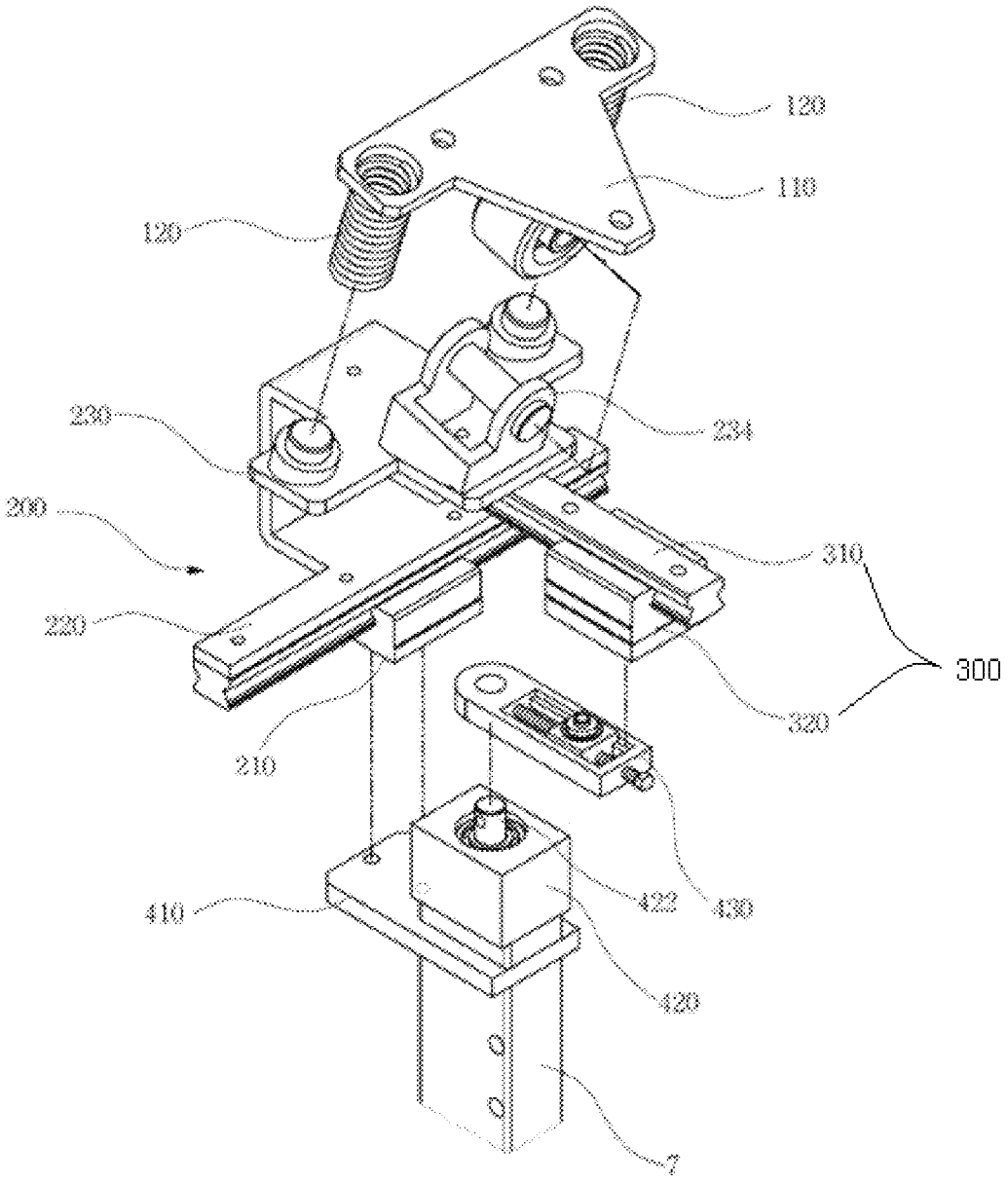

[FIG. 4]
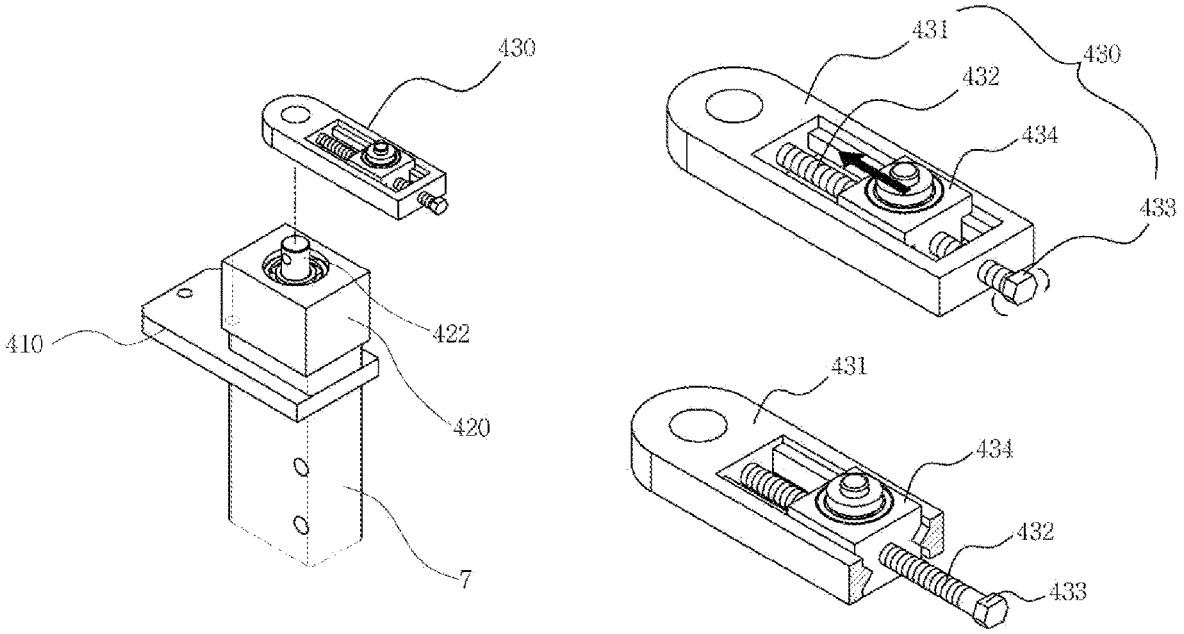
[FIG. 5]
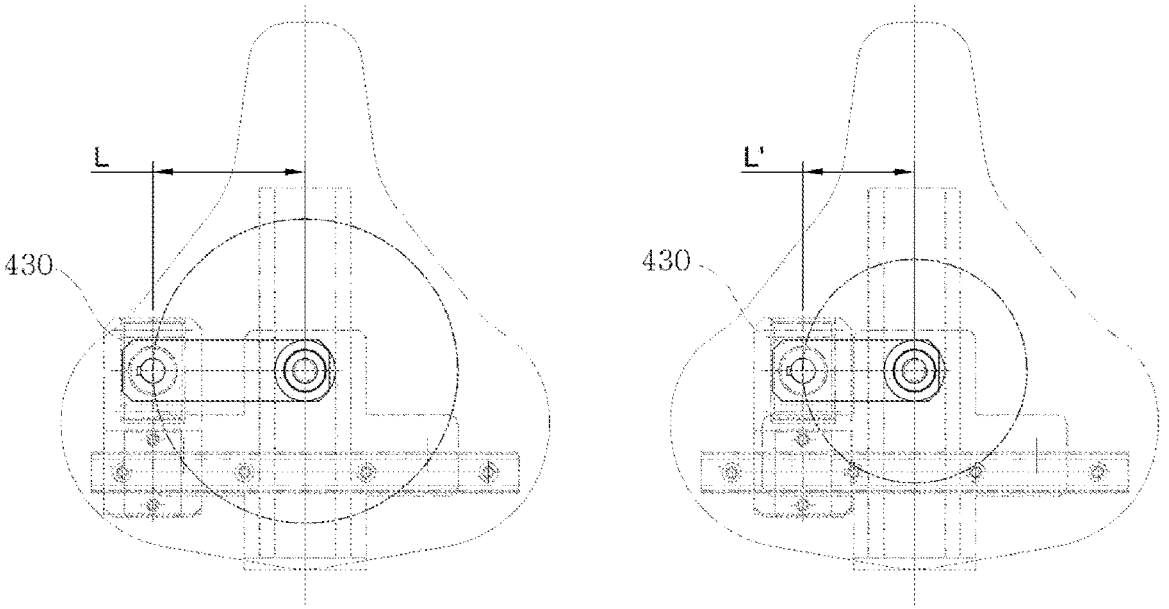

[FIG. 6]
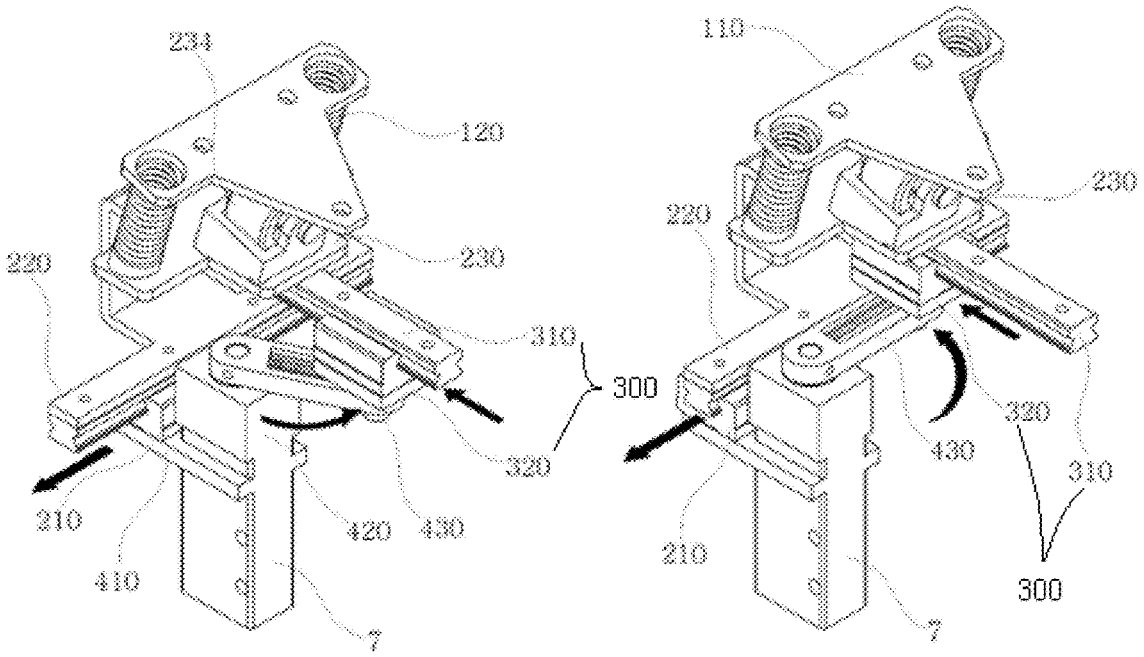
[FIG. 7]
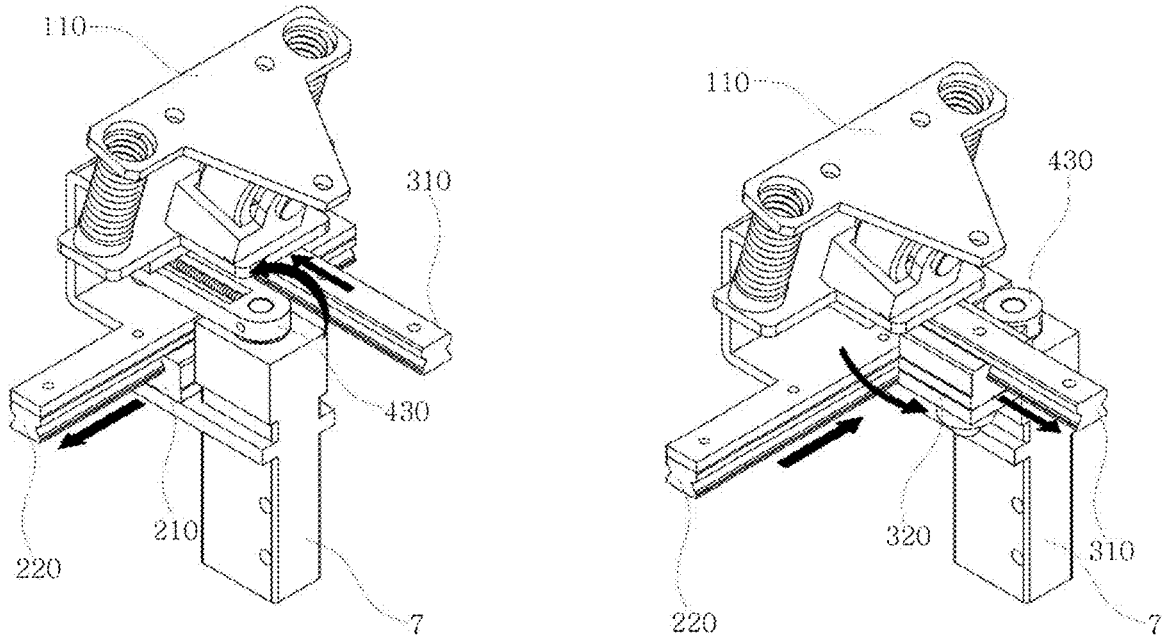

[FIG. 8]
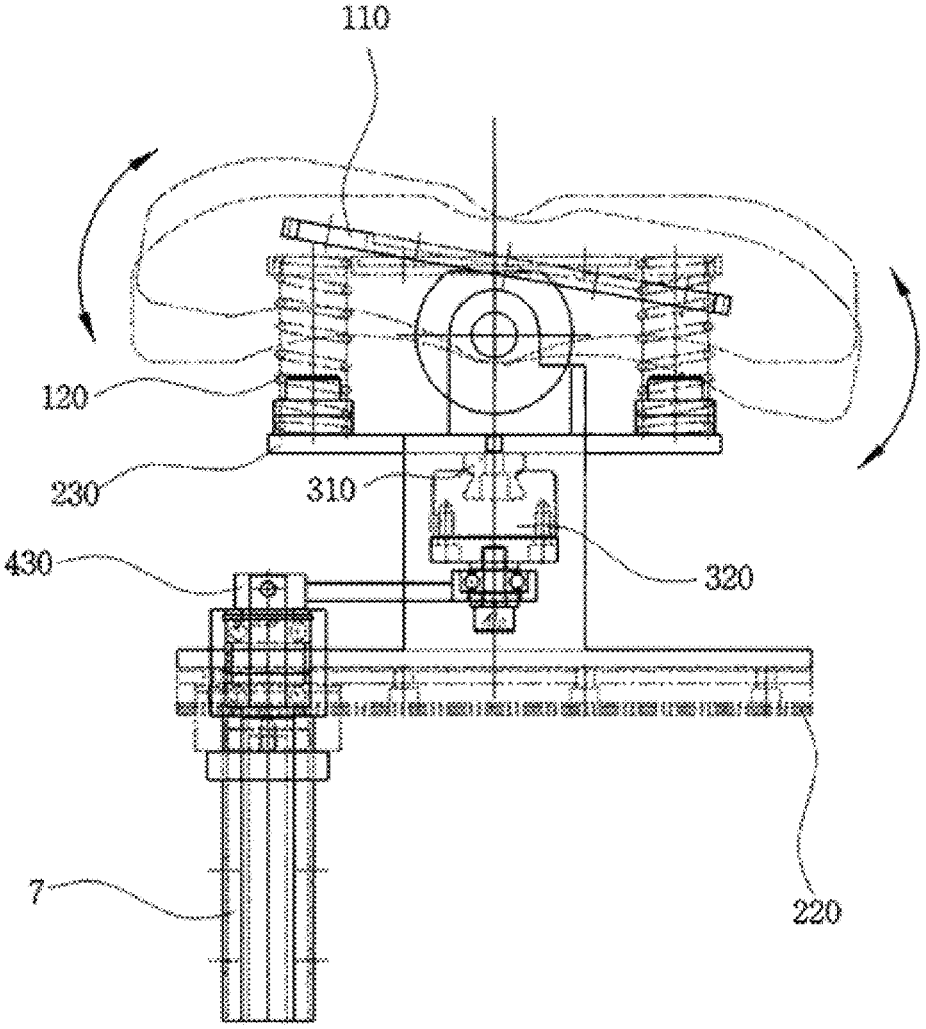

LEFT AND RIGHT OSCILLATION WIDTH ADJUSTMENT AND ROTATION STRUCTURE OF STATIONARY BIKE SADDLE

TECHNICAL FIELD

The present invention relates to a left and right oscillation width adjustment and rotation structure of a stationary bike saddle, and more specifically, to a left and right oscillation width adjustment and rotation structure of a stationary bike saddle, which enables a user to directly perform adjustment according to a range of motion of a hip joint while inducing a buffering action of left and right oscillations of a saddle and a dispersed load when the user is seated on the saddle of a stationary bike and pedals thereon, so as to secure stability for the motion of the pelvis and spine during pedaling, enable core muscle training at the same time as lower body exercise during pedaling, and enable arbitrary adjustment of the oscillation width of the saddle according to a user's body type, etc.

BACKGROUND ART

In these days, modern people spend most of their waking hours in a seating posture on a chair. In accordance with repetition of such lifestyles, chronic physical diseases such as obesity may be obtained. In addition to obesity, scoliosis, which is a disease of a spinal curved in left and right sides, may be obtained, and the scoliosis causes problems in the whole muscle of a body as the spinal curves and is accompanied by neurological diseases. In response, most of modern people do physical exercise as an important factor to minimize deterioration of physical functions only after obtaining obesity and scoliosis as physical diseases.

Upon starting exercise, modern people mainly use a stationary bike, which is cycling exercise equipment with pedaling, as a preventative measure against the above physical diseases, and the stationary bike has been used in a widespread manner as representative aerobic exercise equipment for training a lower body and burning body fat.

It has been known that when people exercise through the stationary bike, effects of losing the body weight, decomposing body fat, developing muscles, preventing joint diseases, preventing migraines, and preventing diabetes may be obtained. However, these are effects that may be obtained when exercising for a long time and regularly. Further, since people exercise while maintaining their seating postures on the equipment or fixed saddle, it may exert an adverse effect due to a burden on the spine of a person with an underlying disease such as scoliosis, unless securing of flexibility in response to a range of motion of a hip joint and stability of movement of the spine are sufficiently considered.

In addition, there is a need to adjust a left and right oscillation width because the left and right oscillation width is fixed according to a physical condition of each user.

In order to solve the above-described problem, many studies on stationary bikes exist from the past to the present, for example, Korean Patent Registration No. 10-1160587 discloses a technical idea for a bike saddle with a sedentary exercise function. According to the technical idea, an unnecessary twisting motion of the saddle may be prevented during sedentary exercise, but a motion of the hip joint is not actively considered, and the user's physical condition may not be reflected.

DISCLOSURE

Technical Problem

The present invention is devised In order to more actively solve the above-described problem, and an object of the present invention is to provide a left and right oscillation width adjustment and rotation structure of a stationary bike saddle, and more specifically, to a left and right oscillation width adjustment and rotation structure of a stationary bike saddle, which enables a user to directly perform adjustment according to a range of motion of a hip joint while inducing a buffering action of left and right oscillations of a saddle and a dispersed load when the user is seated on the saddle of a stationary bike and pedals thereon, so as to secure stability for the motion of the pelvis and spine during pedaling, enable core muscle training at the same time as lower body exercise during pedaling, and arbitrary adjust the oscillation width of the saddle according to a user's body type, etc.

Technical Solution

In order to achieve the technical solution, a left and right oscillation width adjustment and rotation structure of a stationary bike saddle proposed by the present invention is as follows.

According to the present invention, a left and right oscillation width adjustment and rotation structure of a stationary bike saddle includes: a buffering part (100) which is disposed on a bottom surface of the saddle member (8) to relieve left and right oscillations and a load dispersed by a pedaling operation of the user; a left and right moving part (200) which is coupled to the buffering part to perform a left and right sliding motion due to the pedaling operation; a forward and backward moving part (300) which is coupled to the left and right moving part (200) to perform a forward and backward sliding motion; and an eccentric rotating part (400) to which the left and right moving part (300) and the forward and backward moving part (300) are coupled and which is rotated eccentrically to simultaneously control the sliding motion of each moving part, wherein an eccentric rotation radius of the eccentric rotating part (400) is configured to be extended or reduced according to a user's selection, and the left and right sliding motion and the forward and backward sliding motion are controlled according to the adjusted rotation radius.

The buffering part (100) includes: a buffering plate (110) which has a downwardly inclined section and is coupled to an upper portion of the left and right moving part to provide a rotation radius; and a coil part (120) which is composed of a pair and coupled to both sides of a bottom surface of the buffering plate to induce a buffering action of the left and right oscillations of the saddle and the dispersed load.

The left and right moving part (200) includes: a left and right block (210) which is coupled to one side of the eccentric rotating part (400) and kept in position; a left and right motion part (220) which stands upward to the left and right block (210) to provide a sliding distance of the left and right block; and a second left and right connecting part (230) in connection with the left and right motion part (220), in which the buffering part is kept in position on one surface thereof and the forward and backward moving part is kept in position on the other surface.

The second left and right connecting part (230) may further include a left and right oscillation rotating part (234)

which induces hinge-coupling with the buffering part (100) and has an inclination corresponding to an inclined section of the buffering part.

The forward and backward moving part (300) includes: a forward and backward motion part (310) which is fixed to the left and right moving part (200) and provides a forward and backward sliding distance; and a forward and backward block (320) that stands upward to the forward and backward motion part and performs a forward and backward motion on the forward and backward motion part.

The eccentric rotating part (400) includes: a fixing plate (410) which is kept in position while surrounding an outer peripheral surface of the height adjustment bar (7); a rotation connecting part (420) which extends from the fixing plate and includes a protruding part (422) protruding upward from a set position; and a rotation adjusting part (430) which is coupled to the protruding part (422) of the rotation connecting part (420) and configured to extend and reduce the rotation radius while rotating eccentrically in a state in which the coupling is maintained.

The rotation adjusting part (430) includes: a body (431) which is coupled to the rotation connecting part (420) and formed with a hollow region having a set length; a full threaded bolt (432) which passes through a central part of the body in a longitudinal direction; a gripping part (433) which extends or protrudes left and right from an end part of the full threaded bolt or is formed with a key groove to rotate a key left and right to allow the user to grip the gripping part; and a position adjusting part (434) which is disposed in the hollow region of the body, and fastened to the full threaded bolt so that a position thereof in the hollow region of the body is changed by a thread as the full threaded bolt is rotated through manipulation of the gripping part.

Advantageous Effects

According to the present invention including the above-described configuration, as the flexibility corresponding to the range of motion of the hip joint of a human body is secured by inducing the buttering action of the left and right oscillation of the saddle and the dispersed load width and adjusting the left and right oscillation width according to the user's body type, etc. during exercise, a burden on the spine when manipulating the stationary bike is reduced, such that physical stability can be improved even when sedentary exercise can be performed for a long time.

In addition, as compensation for inducing utilization of lower-body joints at a maximum point according to a linear reciprocating motion, a tension in the user's core muscle is induced to train the core muscle, such that even when the user exercises using the stationary bike, the same effect as when the user does a full-body exercise can be obtained.

DESCRIPTION OF DRAWINGS

FIG. 1 is a side view of a stationary bike configured according to a preferred embodiment of the present invention.

FIG. 2 is a perspective view of a stationary bike saddle configured according to the preferred embodiment of the present invention.

FIG. 3 is an exploded perspective view showing a coupling relation in the stationary bike saddle.

FIG. 4 is an enlarged view showing a rotating part in detail.

FIG. 5 is a plan view showing that a range of an eccentric rotation radius is adjusted according to a structure of the rotating part.

FIGS. 6 and 7 are views showing a use status configured according to the preferred embodiment of the present invention.

FIG. 8 is a front view showing an oscillation phenomenon of the saddle by an elastic body.

BEST MODE

There is presented a left and right oscillation width adjustment and rotation structure of a stationary bike saddle, capable of adjusting a height of the stationary bike saddle corresponding to a height of a user seated on a saddle member by a height adjustment bar, the rotation structure of the stationary bike saddle including:

a buffering part which is disposed on a bottom surface of the saddle member to relieve left and right oscillations and a load dispersed by a pedaling operation of the user; a left and right moving part which is coupled to the buffering part to perform a left and right sliding motion; a forward and backward moving part which is coupled to the left and right moving part to perform a forward and backward sliding motion; and an eccentric rotating part to which the left and right moving part and the forward and backward moving part are coupled and which is rotated eccentrically to simultaneously control the sliding motion of each moving part, wherein an eccentric rotation radius of the eccentric rotating part is configured to be extended or reduced according to a users selection, and the left and right sliding motion and the forward and backward sliding motion are controlled according to the adjusted rotation radius;

the eccentric rotating part includes: a fixing plate which is kept in position while surrounding an outer peripheral surface of the height adjustment bar; a rotation connecting part which extends from the fixing plate and includes a protruding part protruding upward from a set position; and a rotation adjusting part which is coupled to the protruding part of the rotation connecting part and configured to extend and reduce the rotation radius while rotating eccentrically in a state in which the coupling is maintained, and the rotation adjusting part includes: a body which is coupled to the rotation connecting part and formed with a hollow region having a set length; a full threaded bolt which passes through a central part of the body in a longitudinal direction; a gripping part which extends or protrudes left and right from an end part of the full threaded bolt or is formed with a key groove to rotate a key left and right to allow the user to grip the gripping part; and a position adjusting part which is disposed in the hollow region of the body, and fastened to the full threaded bolt so that a position thereof in the hollow region of the body is changed by a thread as the full threaded bolt is rotated through manipulation of the gripping part.

MODE FOR INVENTION

The advantages and features of the disclosure and a method of achieving the advantages and features will become more apparent from the embodiment described in detail in conjunction with the accompanying drawings. However, the disclosure is not limited to the disclosed embodiment, but may be implemented in different ways. The embodiment is provided to only complete the disclosure and to allow those skilled in the art to fully understand the category of the disclosure. The disclosure is defined by the category of the claims. In addition, the same reference numerals will be used to refer to the same elements throughout the specification.

In general, the stationary bike includes a handle 1 which supports an upper body of a user during pedaling exercise, a support 2 on which the handle is installed, a ground support 4 which allows the stationary bike to be seated on a ground, an adjustment bar 5 which stands upward onto the ground support with a set distance from the support, a pedal 6 which is coupled to the support, a height adjustment bar 7 which is inserted into the adjustment bar 5 to adjust a height corresponding to a user's body, and a saddle member 8 on which the user is seated, and has a structure in which the user is seated on the saddle member 8, and then presses down the pedal 6 to do sedentary exercise.

It is known that when a user of 50 kg exercises for 30 minutes through the above stationary bike, 184 kcal is consumed. The exercise through the stationary bike enables obtaining effects of losing the body weight, decomposing body fat, developing muscles, preventing joint diseases, preventing migraines, and preventing diabetes.

The above effects can be obtained only through regular exercise for a long time. However, a conventional stationary bike has no device to buffer oscillations that occur during the sedentary exercise, and it is thus not possible to improve a physical function of users with underlying diseases in the spine, and a stationary bike for the purpose of simple training of the lower body only brings development of leg muscles and exercise is performed in a fixed state during pedaling, such that a burden on the spine is increased, resulting in forced suppression of the maximal activation of a hip joint.

Therefore, in order to actively improve the overall problems in the stationary bike that has a lower effective value compared to other conventional equipment, the present invention provides a rotation structure of a stationary bike saddle, which enables a user to directly perform adjustment according to a range of motion of a hip joint while inducing a buffering action of left and right oscillations of a saddle and a dispersed load when the user is seated on the saddle of a stationary bike and pedals thereon, so as to secure stability for the motion of the pelvis and spine during pedaling, enable core muscle strengthening at the same time as lower body exercise during pedaling, and in particular, it should be noted that the rotation structure of the stationary bike saddle enables the user to directly perform adjustment according to the range of motion of the hip joint.

Hereinafter, a configuration of the present invention and a resulting action and effect will be collectively described with reference to the accompanying drawings.

As shown in FIG. 1, the present invention includes: a buffering part 100 which is disposed on a bottom surface of the saddle member 8 to relieve left and right oscillations and a load dispersed by a pedaling operation of the user; a left and right moving part 200 which is coupled to the buffering part to perform a left and right sliding motion; a forward and backward moving part 300 which is coupled to the left and right moving part 200 to perform a forward and backward sliding motion; and an eccentric rotating part 400 to which the left and right moving part 300 and the forward and backward moving part 300 are coupled and which is rotated eccentrically to simultaneously control the sliding motion of each moving part.

In particular, an eccentric rotation radius of the eccentric rotating part 400 is configured to be extended or reduced according to a user's selection, and the left and right sliding motion and the forward and backward sliding motion are controlled according to the adjusted rotation radius.

Namely, the eccentric rotating part 400 includes: a fixing plate 410 which is kept in position while surrounding an outer peripheral surface of the height adjustment bar 7; a rotation connecting part 420 which extends from the fixing plate and includes a protruding part 422 protruding upward from a set position; and a rotation adjusting part 430 which is coupled to the protruding part 422 of the rotation connecting part 420 and configured to extend and reduce the rotation radius while rotating eccentrically in a state in which the coupling is maintained.

The rotation adjusting part 430 includes: a body 431 which is coupled to the rotation connecting part 420 and formed with a hollow region having a set length; a full threaded bolt 432 which passes through a central part of the body in a longitudinal direction; a gripping part 433 which extends or protrudes left and right from an end part of the full threaded bolt using a key in a key groove to rotate a key to allow the user to grip the gripping part; and a position adjusting part 434 which is disposed in the hollow region of the body, and fastened to the full threaded bolt so that a position thereof in the hollow region of the body is changed by a thread as the full threaded bolt is rotated through manipulation of the gripping part, such that it is possible to adjust the rotation radius.

When the user adjusts the rotation radius according to his/her body, the rotation radius may refer to a range of motion of a user's hip joint. That is, the user may adjust the rotation radius several times to suit the range of motion of his/her hip joint before pedaling the stationary bike, so that the left and right moving part 200 and the forward and backward moving part 300 cooperate with each other within the adjusted rotation radius to perform a linear reciprocating motion. In this way, the user directly adjusts the rotation radius to set a range of motion suitable for a shape of the user's spine, such that spine stability may be secured, and in some cases, core muscle strengthening may be induced by setting a rotation radius according to the maximum range of motion of the hip joint.

To this end, the present invention includes the following configuration.

In detail, as shown in FIGS. 2 and 3, the buffering part 100 includes: a buffering plate 110 which has a downwardly inclined section and is coupled to an upper portion of the left and right moving part to provide a rotation radius; and a coil part 120 which is composed of a pair and coupled to both sides of a bottom surface of the buffering plate to induce a buffering action of the left and right oscillations of the saddle and the dispersed load.

The buffering plate 110 has the downwardly inclined section, which allows an upper body to naturally protrude forward when the user is seated on the saddle, to prevent a load of the upper body from being biased to the spine, thereby securing the body stability in pedaling for a long time and allowing the user to focus motions of the hip joint and pelvis. In a general stationary bike, when the pedal is maximally pressed down, an angle of a knee and a foot is formed at 10 to 15°, and correspondingly, when the saddle is positioned at a height according to a length of the user's leg using the height adjustment bar 7, it is preferable to secure flexibility for use of the hip joint by allowing an angle of the upper body according to the angle The coil part 120 is composed of a spring coil to induce a buffering action. Since it is obvious that the effective number of turns of the coils and the like may be freely selected within a range that a load of person is buffered, various ways can be adopted as long as an object of the buffering action can be achieved.

In this case, the buffering plate 110 and the coil part 120 are coupled to an upper portion of the left and right moving part 200, which means that the buffering plate 110 and the coil part 120 are coupled to the second left and right connecting part 230. In detail, the buffering plate 110 may be hinge-coupled to the coupling part 234. That is, the hinge-coupling is performed to have a predetermined rotation radius, and a restoring force of a spring coil of the coil part 120 is exerted when the left and right oscillation occurs by the user.

The left and right moving part 200 includes: a left and right block 210 which is coupled to one side of the eccentric rotating part (400) and kept in position; a left and right motion part 220 which stands upward to the left and right block 210 to induce sliding of the left and right block; and a second left and right connecting part 230 in connection with the left and right motion part 220, in which the buffering part is kept in position on one surface thereof and the forward and backward moving part is kept in position on the other surface.

The left and right block 210 implements the linear reciprocating motion on the left and right motion part 220.

The left and right motion part 220 is formed in a linear shape to stand upward onto the left and right block 210 coupled to the fixing plate 410 and performs the linear reciprocating motion on the left and right connecting part. In particular, the second left and right connection part 230 is integrated with the left and right motion part 220. In this case, the second left and right connecting part 230 may extend from the left and right motion part 220; and a boundary region between the second left and right connecting part 230 and the left and right motion part 220 may be formed as a hollow space.

The forward and backward moving part 300 is inserted into the hollow space as a boundary between the second left and right connection part 230 and the left and right motion part 220 and coupled to one surface of the second left and right connecting part 230, and the one surface herein corresponds to the second left and right connecting part 230. According to this, the other surface corresponds to an outer surface of the second left and right connecting part 230, and thus the buffering part 100 is coupled to the outer surface, that is, the upper portion of the second left and right connecting part. The second left and right connecting part 230 may further include a coupling part 234 which is hinge-coupled with the buffering part 100 and has an inclination corresponding to an inclined section of the buffering part. The actions of the coupling part 234 and the buffering part 100 are the same as described above.

The forward and backward moving part 300 includes: a forward and backward motion part 310 which is fixed to the left and right moving part 200 and provides a forward and backward sliding distance; and a forward and backward block 320 that stands upward to the forward and backward motion part and performs a forward and backward motion of the forward and backward motion part.

The forward and backward motion part 310 is formed in a linear shape, and stands upward to the forward and backward block 230 while being fixed to the left and right moving part 220 and the second left and right connecting part 230. In other words, a lower portion of the forward and backward motion part 310 stands upward to the forward and backward block 320 and an upper portion thereof is coupled to an inner surface of the second left and right connecting part 230 of a left and right sliding part 200. According to this configuration, a forward and backward reciprocating motion may be performed without interference.

The forward and backward block 230 is configured to connect the forward and backward motion part 310 and an eccentric rotating part 400 to be described later, which is different from the forward and backward block 210 that is kept in position by being coupled to one side of the eccentric rotating part 400. To explain the overall coupled state, the forward and backward motion part 310 stands upward onto the forward and backward block 320, and the forward and backward block 320 slides on the forward and backward motion part 310 forward and backward by a rotating force applied from the rotation adjusting part while coupling a bottom surface of the block to the rotation adjusting part 430 of the eccentric rotating part 400.

A sliding motion of the left and right moving part 200 and the forward and backward moving part 300 described above is due to a rotation motion of the eccentric rotating part 400 as a feature of the present invention and due to a distance in which a reciprocating motion is performed and extension or reduction of the rotation radius of the eccentric rotating part 400.

Hereinafter, the eccentric rotating part 400, which is a feature of the present invention, for controlling the left and right moving part 200 and the forward and backward moving part 300 will be described with reference to FIGS. 4 and 5.

First, the overall motion of the present invention is performed by the left and right sliding part 200 and the forward and backward sliding part 300 as the eccentric rotating part 400 rotates in response to the motion of hip joint and positional change of the pelvis due to the motion of hip joint when the user is seated on the saddle and pedals with the lower body. In this case, the above motion is collectively performed in such a manner that the buffering part 100 performs the buffering action with respect to a load selectively applied by a left and right pelvis according to the pedaling.

In particular, the user directly adjusts the rotation radius in response to the positional change of the pelvis due to the motion of hip joint, thereby reducing the burden on the spine and maintaining balance of the body.

To this end, the eccentric rotating part 400 includes: a fixing plate 410 which is kept in position while surrounding an outer peripheral surface of the height adjustment bar 7; and the rotation adjusting part 430 which is coupled to a protruding part 422 of the rotation connecting part 420 and configured to extend or reduce the rotation radius while rotating eccentrically in a state in which the corresponding coupling is maintained, wherein the rotation adjusting part 430 includes: a body 431 which is coupled to the rotation connecting part 420 and formed with a hollow region having a set length; a full threaded bolt 432 which passes through a central part of the body in a longitudinal direction; a gripping part 433 which extends or protrudes left and right from an end part of the full threaded bolt or is formed with a key groove to rotate a key left and right to allow the user to grip the gripping part; and a position adjusting part 434 which is disposed in the hollow region of the body, and fastened to the full threaded bolt so that a position thereof in the hollow region of the body is changed by a thread as the full threaded bolt is rotated through manipulation of the gripping part.

In detail, the rotation adjusting part 430 includes various embodiments.

The rotation adjusting part 430 may be configured to have a different length formed during manufacturing. This is to be an average value of a physical characteristic or enables selective assembly according to a gender difference, that is, a width value of the pelvis.

That is, a change in the length of the rotation adjusting part 430 means that a coupling distance between the protruding part 422 and the forward and backward block 320, that is, a distance between them is changed, and for example, as a distance between the protruding part and the forward and backward block increases because the length of the rotating part is long, the eccentric rotation radius extends, in contrast, as the distance between the protruding part and the forward and backward block is narrowed because the length of the rotating part is short, the eccentric rotation radius is reduced. As described above, a selective assembly is made according to the physical condition of the user by processing the rotation adjusting part 430 into a rotation adjusting part 430 having a long length and a rotation adjusting part having a short length, and alternatively, a general-purpose structure may be provided in which stability, usability, convenience, etc. may be improved by enabling the rotation adjusting part 430 to finely adjust a length thereof by itself. Alternatively, the rotation adjusting part 430 of the present invention is provided with a hole for rotational coupling with the protruding part 422 at one end thereof. In this case, it is obvious that a plurality of holes are arranged at equal intervals, and the user may select any one of the plurality of holes according to his/her physical condition to fasten to the protruding part 422, thereby adjusting the eccentric rotation radius of the saddle. For example, as the protruding part 422 is fastened to the hole formed at a position close to the forward and backward block 320, the eccentric rotation radius of the saddle is reduced.

Preferably, the rotation adjusting part 430 of the present invention includes: a body 431 which includes the rotating part and formed with a hollow region at a central part thereof; a full threaded bolt 432 which passes through a central part of the body in a longitudinal direction; a gripping part 433 which extends or protrudes left and right from an end part of the full threaded bolt or is formed with a key groove to rotate a key left and right to allow the user to grip the gripping part; and a position adjusting part 434 which is disposed in the hollow region of the body, and fastened to the full threaded bolt so that a position thereof in the hollow region of the body is changed by a thread as the full threaded bolt is rotated through manipulation of the gripping part.

As shown in FIG. 5, the user rotates the full threaded bolt in a clockwise or counterclockwise direction using the gripping part 433 to change the position of the position adjusting part 434 and adjust the eccentric rotation radius of the saddle.

For example, the eccentric rotation radius of the saddle extends as the position of the position adjusting part 434 moves away from the protruding part 422, and the eccentric rotation radius of the saddle decreases as the position of the position adjusting part approaches the protruding part. Therefore, the eccentric rotation radius of the saddle may be easily changed according to the user's physical condition by using a principle of rotation sliding of the full threaded bolt 432 and the position adjusting part 434.

In addition, a method for adjusting an eccentric rotation radius presented in FIGS. 4 and 5 is merely related to an embodiment of the present invention, but is not limited thereto, and since the configuration is implemented to adjust the rotation radius, it is needless to say that any one is employed as long as the object is achieved.

When the rotation radius may be adjusted in this way, the user may select the rotation radius suitable for his/her body, such that the stability can be improved, and ease of manipulation and convenience can be secured.

Hereinafter, a motion of the present invention will be described with reference to FIGS. 6 to 8 based on the configuration of the present invention described above.

As shown in FIGS. 6 and 7, the user adjusts the rotation radius of the eccentric rotating part 400 by manipulating the gripping part 433 of the rotation adjusting part 430 before or simultaneously pedaling, an adjustment motion may mean a time when the rotation radius corresponding to the range of motion of the user's hip joint and the spine flexibility is provided. In this state, when the user is seated on the saddle member 8 to apply a load for pedaling, the forward and backward block 310 connected to the rotation adjusting part 430 performs the linear reciprocating motion by a distance provided through the forward and backward motion part 320, and at the same time, the left and right block 210 performs the left and right sliding, that is, the linear reciprocating motion on the left and right motion part 220.

When the pelvis is positioned at both maximum points as the hip joint moves according to the reciprocating motion of the left and right motion part 220, the core muscle such as an oblique muscle may be strained for maintaining a natural balance of the body, so that the core muscles may be strengthened even by exercising through the stationary bike.

In addition, as shown in FIG. 8, a predetermined rotation radius is provided in a state in which the buffering plate 110 is coupled to the second left and right connection part 230 to exert the restoring force by the coil part 120 to compensate left and right oscillations while actively accommodating the left and right oscillations. As a whole, the motion biased to the left and right sliding part 200 and the forward and backward sliding part 300 is compensated by the buffering part 100, thereby further reducing the burden applied to the spine of the user.

As a result, the stationary bike is equipment that is widespread due to an advantage that it enables exercise at home without visiting a gym for physical training by providing a separate time. As described above, the stationary bike may obtain various beneficial effects on the body, in particular, the training of the lower body muscle and calorie consumption when the training lasts for more than 30 minutes. In terms of physical strength training other than burning of body fat, which is a common effect of normal aerobic exercise, the effect is insignificant, unlike the known understanding.

Meanwhile, in order to increase the insignificant effect, it is necessary to exercise for a long time with the stationary bike, which is likely to have a harmful effect rather than a beneficial effect for modern people who have become accustomed to a sedentary lifestyle and acquire underlying diseases. For example, the burden on a waist increases due to the sedentary exercise for a long time. This is due to the limitations of the sedentary exercise in which the upper body is fixed and only the muscles of the lower body are concentrated.

Therefore, the present invention has a feature that it can reduce the burden on a waist and provides a dramatic improvement effect by deviating from the above limitations during the exercise for a long time, for example, the user can adjust a motion according to the range of motion of the user's hip joint and the spine flexibility through the rotation adjusting part 430, and the buffering part 100 can serve as compensation for the linear reciprocating motion of the left and right moving part 200 and the forward and backward moving part 300 due to the adjustment.

In particular, the user may set a pedaling environment suitable for his/her physical condition through the configuration of the rotation adjusting part 430, and accordingly, as a sliding motion is provided, stability and manipulability are improved.

In some cases, the user may induce core muscle training by providing the maximum rotation radius by manipulating the rotation adjusting part 430 in the maximum range of motion of his/her hip joint.

While the present invention has been described with reference to the embodiment shown in the accompanying drawings, it is merely illustrative, and it will be understood by those of ordinary skill in the art that various changes and equivalent other embodiments may be made therefrom. Accordingly, the scope of protection of the present invention should be defined by the following claims, and all technical spirits falling within the scope equivalent thereto should be construed as being included in the scope of the present invention.

The invention claimed is:

1. A left and right oscillation width adjustment and rotation structure of a stationary bike saddle, capable of adjusting a height of the stationary bike saddle by a height adjustment bar (7), the rotation structure of the stationary bike saddle comprising:

a buffering part (100) which is disposed on a bottom surface of the saddle member (8) to relieve left and right oscillations and a load dispersed by a pedaling operation of the user; a left and right moving part (200) which is coupled to the buffering part to perform a left and right sliding motion;

a forward and backward moving part (300) which is coupled to the left and right moving part (200) to perform a forward and backward sliding motion; and an eccentric rotating part (400) to which the left and right moving part (300) and the forward and backward moving part (300) are coupled and which is rotated eccentrically to simultaneously control the sliding motion of each moving part, wherein an eccentric rotation radius of the eccentric rotating part (400) is configured to be extended or reduced according to a user's selection, and the left and right sliding motion and the forward and backward sliding motion are controlled according to an adjusted rotation radius, the eccentric rotating part (400) includes:

a fixing plate (410) which is kept in position while surrounding an outer peripheral surface of the height adjustment bar (7);

a rotation connecting part (420) which extends from the fixing plate and includes a protruding part (422) protruding upward from a set position; and a rotation adjusting part (430) which is coupled to the protruding part (422) of the rotation connecting part (420) and configured to extend and reduce the rotation radius while rotating eccentrically in a state in which the coupling is maintained, and the rotation adjusting part (430) includes: a body (431) which is coupled to the rotation connecting part (420) and formed with a hollow region having a set length;

a full threaded bolt (432) which passes through a central part of the body in a longitudinal direction; a gripping part (433) which extends or protrudes left and right from an end part of the full threaded bolt or is formed with a key groove to rotate a key left and right; and a position adjusting part (434) which is disposed in the hollow region of the body and fastened to the full threaded bolt so that a position thereof in the hollow region of the body is changed by a thread as the full threaded bolt is rotated through manipulation of the gripping part.

* * * * *